US005262749A

United States Patent [19]

Kopelman

[11] Patent Number: 5,262,749

[45] Date of Patent: Nov. 16, 1993

[54] ELECTRICAL SAFETY DEVICE

[75] Inventor: Robert Z. Kopelman, Rockville Centre, N.Y.

[73] Assignee: Opti-Lume Industries, Inc., Bayside, N.Y.

[21] Appl. No.: 851,838

[22] Filed: Mar. 16, 1992

[51] Int. Cl.[5] ..... H01H 61/02; H01H 71/08

[52] U.S. Cl. ..... 337/103; 337/113

[58] Field of Search ..... 337/103, 104, 105, 112, 337/113; 361/103, 105; 219/511; 307/117

[56] References Cited

U.S. PATENT DOCUMENTS 4,514,715 4/1985 Chen ..... 337/113

4,580,123 4/1986 Roller et al. ..... 337/103

FOREIGN PATENT DOCUMENTS 578131 6/1959 Canada ..... 337/113

*Primary Examiner*—Harold Broome

*Attorney, Agent, or Firm*—Kane, Dalsimer, Sullivan, Kurucz, Levy, Eisele and Richard

[57] ABSTRACT

An electrical safety device is provided with a heat responsive relay adapted to be interposed between a load and a power source. The relay is adapted to open circuit in response to a predetermined temperature. A heater element responsive to the opening of the relay is shunted across the relay. When the relay opens, power is shunted to the heater for maintaining the relay at least at the predetermined temperature thereby holding the relay open while the load remains connected to said power source.

4 Claims, 2 Drawing Sheets

ELECTRICAL SAFETY DEVICE

BACKGROUND OF THE INVENTION

The present invention relates to an electrical safety device and in particular to a circuit interrupter which acts to open the circuit to a load in the event of overheating of the load or the line carrying power to the load.

In my U.S. Pat. No. 4,903,162 I describe a circuit interrupt device which, in the event of an overheating of the load or line carrying power to the load serves to open circuit the line and to maintain the open circuit for a predetermined time sufficient to permit the cooling of the line to thereby reduce the danger of a fire. Such overheating commonly occurs in electrical tools and appliances where, for example the tool or appliance is overloaded. While the device disclosed in the above referenced patent reduces the danger of fire resulting from overheating of the line or load, a potential danger exists in that the tool or appliance may restart unexpectedly by itself once the line and/or load cools down. The danger where the load comprises a cutting tool or the like is self apparent.

SUMMARY OF THE INVENTION

In view of the above it is a principle object of the present invention to provide an improved electrical safety device which serves to open the circuit to a load in the event of overheating and which further serves to maintain the circuit open even after the overheating has cooled down until the load has cooled down and been disconnected from the power source. The load may then only be restarted after being reconnected to the power source.

The above and other objects and advantages are attained in accordance with the present invention by providing an electrical safety device comprising a heat responsive relay adapted to be interposed between a load and a power source. The relay is adapted to open circuit in response to a predetermined temperature. A heater element responsive to the opening of said relay is shunted across the relay. When the relay opens power is shunted to the heater for maintaining the relay at least at the predetermined temperature thereby holding the relay open while the load remains connected to said power source.

DETAILED DESCRIPTION OF THE PREFERRED EMBODIMENT

Figure 1:
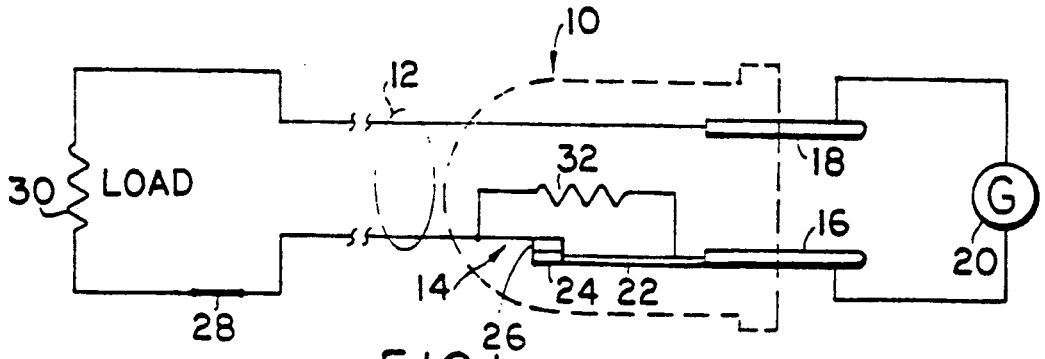
FIG. 1 is a simplified schematic view of the safety device of the present invention during normal operation of the load.

Reference is now made to the drawings wherein a plug 10 of a cord set 12 containing the safety device 14 of the present invention is depicted. The plug 10 is provided with prongs 16, 18 which are polarized to connect with the hot and neutral slots respectively of a conventional outlet. The outlet, in turn, is connected through power lines to power source 20.

Figure 2:
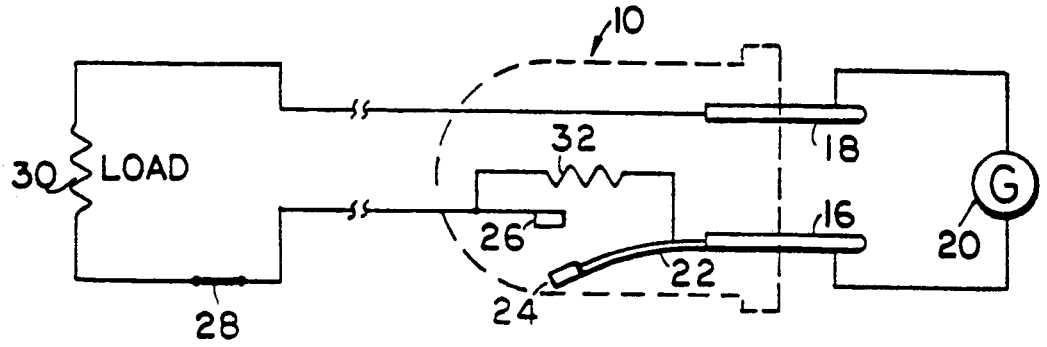
FIG. 2 is a view similar to FIG. 1 depicting the safety device in the event of an overheating situation.

In accordance with the present invention prong 16 is connected in series with a responsive relay 22, which may, for example, comprise a bimetallic strip adapted to snap open when heated to a predetermined temperature. Thus, the contacts 24, 26 are normally closed as shown in FIG. 1. However, if the relay 22 is heated above the predetermined temperature the bimetallic flexes to open the relay contacts 24, 26 as shown in FIG. 2.

As shown, the relay 22 is connected through the cord set 12 and a switch 28 to load 30. The switch 28 is the conventional ON/OFF switch for the load. The circuit to the load is then completed through the cord set to prong 18 of the plug.

In accordance with the present invention a heating element 32 is shunted across relay 22. The heating element 32 is chosen to (a) generate sufficient heat to cause the bimetallic to remain in the flexed, open position of FIG. 2 and (b) draw sufficient current so as to prevent operation of the load 30 when connected in series with the load. To this end, the heating element may conveniently be housed along with the relay within plug 10 to maintain the heating element in close proximity with the relay to facilitate the heating of the relay.

The operation of the safety device of the present invention is now described in connection with FIGS. 1–4. FIG. 1 shows the normal operating condition for the circuit feeding load 30. The heating element is shorted out by the relay 22 allowing sufficient current flow to operate the load 30.

Figure 3:
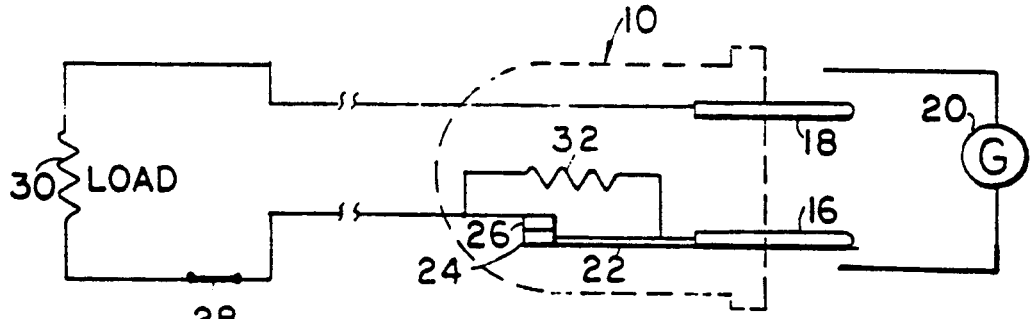
FIG. 3 is a view similar to FIG. 2 after the load has been disconnected from the power source.
Figure 4:
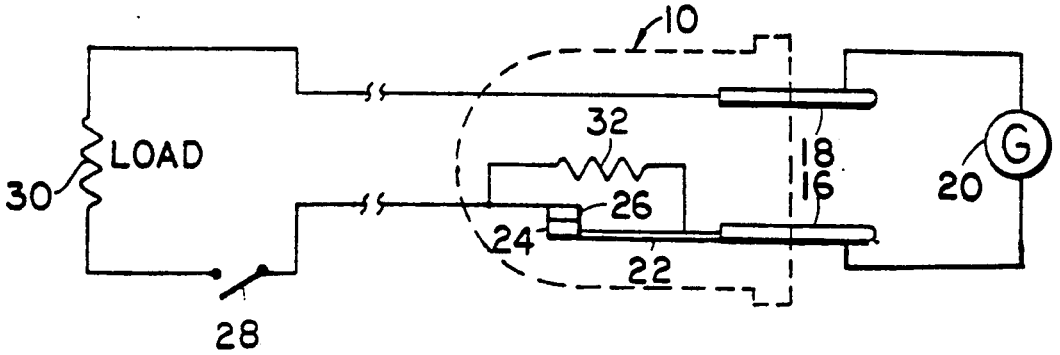
FIG. 4 is a view similar to FIG. 3 with the load turned off.

In the event of an overheating in the prongs, cord set or load, heat is conducted to the relay through the cord set. If the relay is heated to the predetermined temperature it snaps open thereby diverting current to the load to flow through heating element 32. As noted above, the resistance value of heating element 32 is chosen so as to prevent further operation of the load. The flow of current through the heating element 32 maintains the relay in the open condition and at the same time prevents the relay from cooling down. This condition remains until the prongs are removed from the outlet as shown in FIG. 3 or the switch is opened as shown in FIG. 4. In either case the load is physically separated from the power supply and the heating element is thus deactivated. This permits the relay to cool down and eventually snap to its original position as shown in FIG. 1 as long as the load remain disconnected from the power source during cool down. After the relay cools down, if the load is reconnected to the power source and/or the switch turned ON the load will then operate normally.

Figure 5:
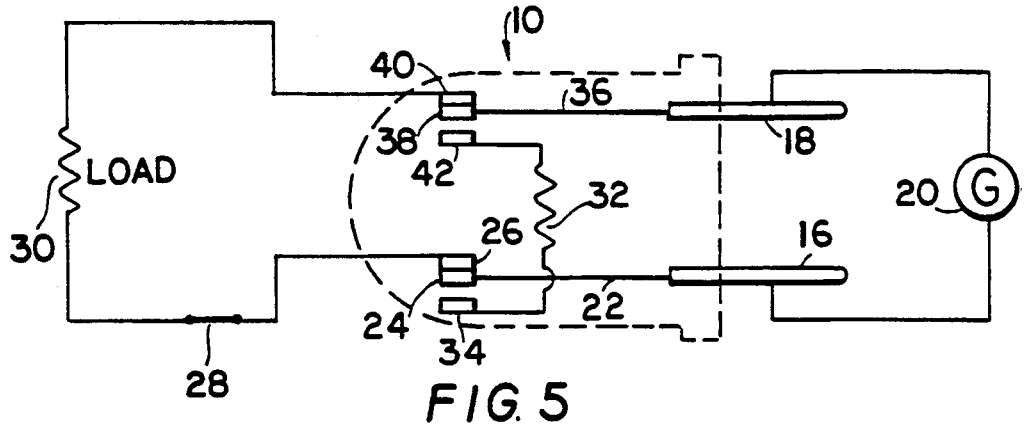
FIG. 5 is a view similar to FIG. 1 of a second embodiment of the invention.
Figure 6:
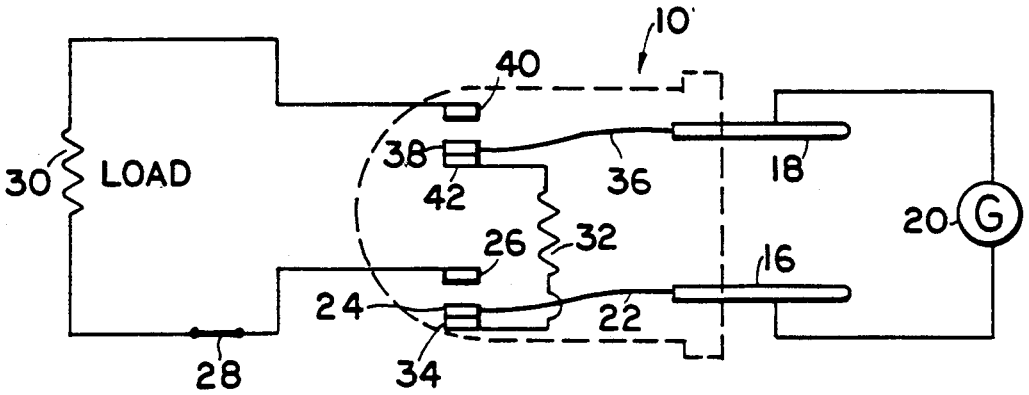
FIG. 6 is a view similar to FIG. 2 for the second embodiment.
Figure 7:
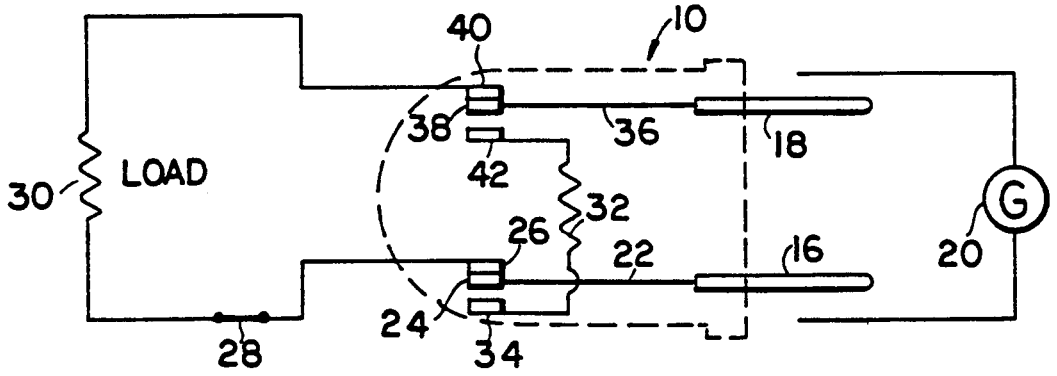
FIG. 7 is a view similar to FIG. 3 for the second embodiment.

In FIGS. 5–7 a second embodiment of the invention is depicted. In this embodiment the bimetal of relay 22 causes the contact 24 to move between contacts 26 and 34. Contact 26 serves to connect the hot lead of the power supply 20 to load 30 as in the first embodiment. The second contact 34 is connected to one side of heating element 32. In accordance with this embodiment the neutral return of the power is connected to load 30 through a second relay 36. Relay 36 operates in a fashion similar to relay 22. Thus, in its normal operating condition the return lead from the load connects through contact 40 to contact 38 of relay 36. The second contact 42 of relay 36 is connected to the other side of heating element 32. The relays 22 and 36 are ganged together to move together.

In operation power to load 30 during normal operation flows through contacts 24, 26 of relay 22 to load 30 and returns through contacts 40, 38 of relay 36. In the event of overheating, the relays snap to their second positions as shown in FIG. 6. In this position the load 30 is isolated from the power supply and power is provided to the resistive element 32 through contacts 24, 34 of relay 22 and contacts 38, 42 of relay 36. The heating element then serves to heat the bimetallics of the relays to maintain the relays open. Upon removing the prongs 16, 18 from the power outlet the relays are permitted to cool down as shown in FIG. 7.

Thus in accordance with the above the aforementioned objectives are effectively attained. While preferred embodiments of the invention have been described it should be readily apparent that equivalent circuits and methods of opening the contacts may be available.

Having thus described the invention, what is claimed is:

1. An electrical safety device comprising:

heat responsive relay means adapted to be interposed between a load and a power source, said relay means being adapted to open circuit in response to a predetermined temperature; and, means responsive to the opening of said relay means for maintaining said relay means at least at said predetermined temperature while said load remains connected to said power source;

said relay means comprises a first relay interposed between a hot side of said power source and said load and a second relay interposed between a return side of said power source and said load; and, said maintaining means comprises a resistive element and each of said first and second relays includes a first contact connected to said load, a second contact connected to said resistive element and means for shifting a hot lead and a return lead of said power source from said load contacts to said maintaining means contacts only when said relay exceeds said predetermined temperature.

2. The safety device in accordance with claim 1 wherein said relay and maintaining means are housed within a cord set for said load.

3. The safety device in accordance with claim 2 wherein said relay and maintaining means are housed within a plug of said cord set.

4. The safety device in accordance with claim 1 wherein said shifting means comprises a bimetallic element.

* * * * *